United States Patent [19]

Vargas et al.

[11] Patent Number: 4,925,256

[45] Date of Patent: May 15, 1990

[54] CONVERTIBLE SOFA TABLE

[76] Inventors: Augustin Vargas, 144 Seaman Ave., New York, N.Y. 10034; George Spector, 233 Broadway, #3815, New York, N.Y. 10007

[21] Appl. No.: 413,088

[22] Filed: Sep. 27, 1989

[51] Int. Cl.[5] ..... A47B 83/00

[52] U.S. Cl. ..... 312/237; 297/163; 312/231; 312/235.2; 312/235.7

[58] Field of Search ..... 312/241, 235.2, 235.5, 312/237, 231, 235.7; 297/144, 146, 163

[56] References Cited

U.S. PATENT DOCUMENTS

| | | | |
|---|---|---|---|
| 3,341,198 | 9/1967 | Turpin | 297/163 X |
| 3,387,882 | 6/1968 | Mycue | 297/163 |
| 3,476,456 | 11/1969 | Canavan | 312/231 |
| 4,040,693 | 8/1977 | Peterson et al. | 312/237 X |
| 4,076,348 | 2/1978 | Allison | 312/231 |
| 4,856,856 | 8/1989 | Winstone | 312/231 |

*Primary Examiner*—Joseph Falk

[57] ABSTRACT

A convertible sofa table is provided and consists of a file cabinet conformed in the shape of a sofa on one side with seat and backrest cushions and a foldable table top having two leaves hinged together which open up into a drafting table. A support is hinged to the top of the file cabinet so that one of the leaves can be horizontally positioned to act as a regular table.

4 Claims, 1 Drawing Sheet

CONVERTIBLE SOFA TABLE

BACKGROUND OF THE INVENTION

The instant invention relates generally to furniture and more specifically it relates to a convertible sofa table which provides a filing cabinet that houses a sofa which can open into a table and drafting table.

There are available various conventional furniture which do not provide the novel improvements of the invention herein disclosed.

SUMMARY OF THE INVENTION

A primary object of the present invention is to provide a convertible sofa table that will overcome the shortcomings of the prior art devices.

Another object is to provide a convertible sofa table in which a file cabinet is conformed in the shape of a sofa on one side that can open up into a regular table and drafting table.

An additional object is to provide a convertible sofa table in which a support for the table top is adjustable to change the angle of the table top.

A further object is to provide a convertible sofa table that is simple and easy to use.

A still further object is to provide a convertible sofa table that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
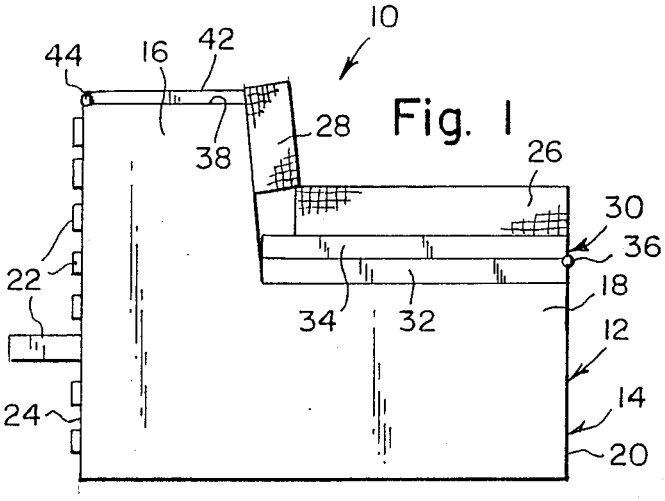
FIG. 1 is a side view of the invention in a closed position so that it can be as a filing cabinet and sofa.
Figure 2:
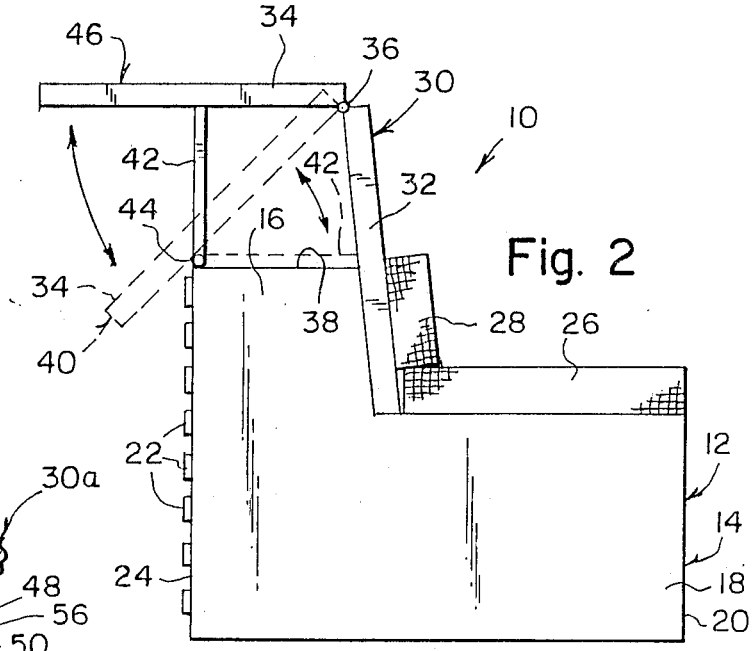
FIG. 2 is a side view similar to FIG. 1, showing the invention in an open position so that it can be as a filing cabinet, sofa, table or drafting table.

Turning now descriptively to the drawings, in which similar reference characters denote similar elements throughout the several views, FIGS. 1 and 2 illustrate a convertible sofa table 10 comprising a file cabinet 12 shaped as a sofa 14 having a backrest 16 and a seat portion 18 on one side 20 and with a plurality of file draws 22 on opposite side 24 thereof. A seat cushion 26 is sized to fit upon the seat portion 18 of the file cabinet 12. A backrest cushion 28 is sized to fit against the backrest 16 of the file cabinet 12.

A foldable table top 30 is also provided having two leaves 32 and 34 hinged together at 36. In an unused position (FIG. 1) the leaves 32 and 34 can be folded together and placed upon the seat portion 18 of the file cabinet 12 with the seat cushion 26 placed thereupon. In a usable position (FIG. 2) the leaves 32 and 34 can be opened with the first leaf 32 placed against the backrest 16 of the file cabinet 12 with the backrest cushion 28 against the first leaf 32, while the second leaf 34 can rest at an angle (shown in phantom) against top 38 of the filing cabinet 12 to act as a drafting table 40.

A support 42 is hinged at one end 44 to the top 38 of the file cabinet 12 above the file draws 22 so that the support 42 can elevate the second leaf 34 in a horizontal position so as to act as a regular table 46.

Figure 5:
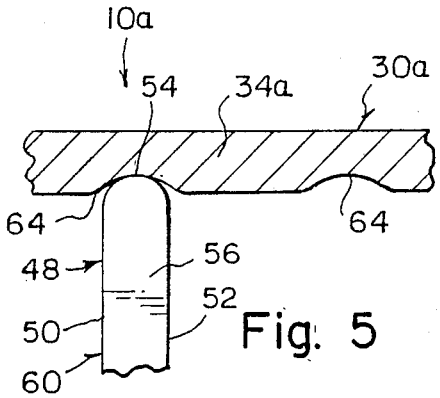
FIG. 5 is an enlarged cross sectional view taken along line 5—5 in FIG. 3, showing the table top having bottom indentations for top of the slide member to be received for stabilization thereto.
Figure 3:
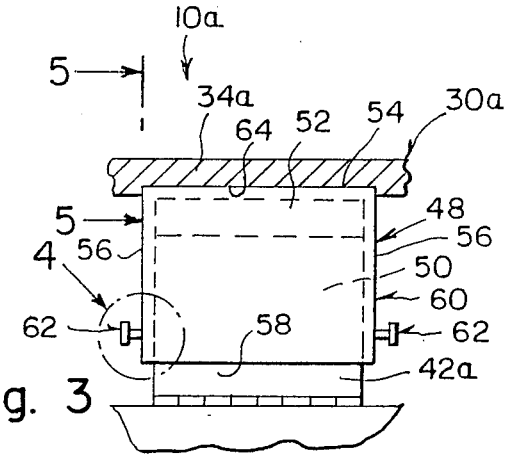
FIG. 3 is a rear view showing a modified table top support being height adjustable.
Figure 4:
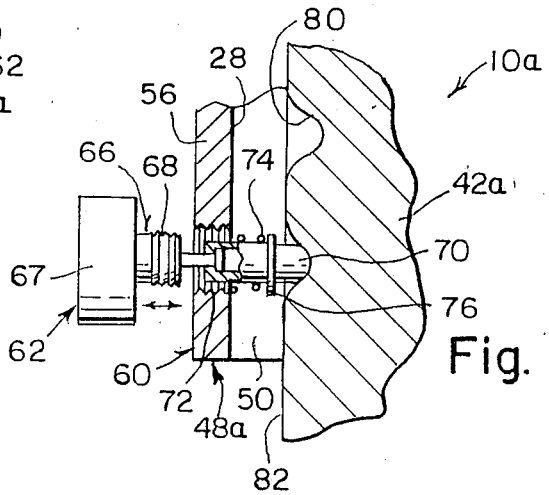
FIG. 4 is an enlarged cross sectional view as indicated by arrow 4 in FIG. 3, showing one of the retaining members in greater detail.

FIGS. 3, 4 and 5 show a modified convertible sofa table 10a that includes a slide member 48 having a front wall 50, rear wall 52, top wall 54, a pair of side walls 56 and an open bottom 58 forming a receptacle 60 to fit over and slide with respect to the support **42*a* making the support height adjustable for changing the angle of engagement with the second leaf 34*a* of the table top 30*a*. Retains 62 are provided for retaining the slide member 48 to the support 42*a* at any desired height. The second leaf 34*a* has a plurality of bottom indentations 64, each to receive the top wall 54 of the slide member 48 for stabilizing the second leaf 34*a*** at any angle thereto.

Each retainer 62, as best seen in FIG. 4, includes a telescopic shaft 66 connected to a head 67 having one portion 68 threaded. The unthreaded portion 70 of the shaft 66 extends through a threaded hole 72 in the side wall 56. A spring 74 is captured between a stationary washer 76 on the unthreaded portion 70 and inner surface 78 of the side wall 56 so as to keep the unthreaded portion 70 biased into one of a series of spaced apart indentations 80 along side 82 of the support **42*a*. when the threaded portion 68 is pushed into the threaded hole 72 and turned the unthreaded portion 70 will move out of the indentation 80 to release the slide member 48**.

Figure 6:
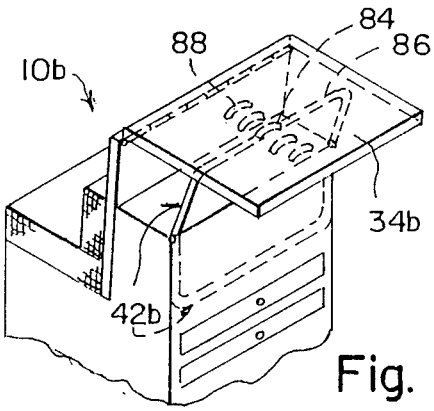
FIG. 6 is a rear perspective view of another modified table top support in which the table top can be set at various angles thereto.

FIG. 6 shows still another modified convertible sofa table **10*b* that includes a projection 84 extending from top 86 of the support 42*b*. The second leaf 34*b* has a plurality of bottom indentations 88, each to receive the projection 84 for stabilizing the second leaf 34*b*** at any angle thereto.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A convertible sofa table which comprises:

(a) a file cabinet shaped as a sofa having a backrest and a seat portion on one side and with a plurality of file draws on opposite side thereof;

(b) a seat cushion sized to fit upon said seat portion of said file cabinet;

(c) a backrest cushion sized to fit against said backrest of said file cabinet; and (d) a foldable table top having two leaves hinged together so that in an unused position said leaves can be folded together and placed upon said seat portion of said file cabinet with said seat cushion placed thereupon and in a usable position said leaves can be opened with said first leaf placed against said backrest of said file cabinet with said backrest cushion against said first leaf, while said second leaf can rest at an angle against top of said filing cabinet to act as a drafting table.

2. A convertible sofa table as recited in claim 1, further including a support hinged at one end to said top of said file cabinet above said file draws so that said support can elevate said second leaf in a horizontal position so as to act as a regular table.

3. A convertible sofa table as recited in claim 2, further including;

(a) a slide member having a front wall, rear wall, top wall, a pair of side walls and an open bottom forming a receptacle to fit over and slide with respect to said support making said support height adjustable for changing the angle of engagement with said second leaf of said table top;

(b) means for retaining said slide member to said support at any desired height; and (c) said second leaf having a plurality of bottom indentations, each to receive said top wall of said slide member for stabilizing said second leaf at any angle thereto.

4. A convertible sofa table as recited in claim 2, further including:

(a) a projection extending from top of said support; and (b) said second leaf having a plurality of bottom indentations, each to receive said projection for stabilizing said second leaf at any angle thereto.

* * * * *